United States Patent [19]

Goronkin et al.

[11] Patent Number: 5,007,873

[45] Date of Patent: Apr. 16, 1991

[54] NON-PLANAR FIELD EMISSION DEVICE HAVING AN EMITTER FORMED WITH A SUBSTANTIALLY NORMAL VAPOR DEPOSITION PROCESS

[75] Inventors: Herbert Goronkin, Scottsdale, Ariz.; Robert C. Kane, Woodstock, Ill.

[73] Assignee: Motorola, Inc., Schaumburg, Ill.

[21] Appl. No.: 477,694

[22] Filed: Feb. 9, 1990

[51] Int. Cl.[5] ..... H01J 9/02

[52] U.S. Cl. ..... 445/49; 437/80; 437/203; 313/309

[58] Field of Search ..... 445/49; 313/309; 437/80, 187, 203

[56] References Cited

U.S. PATENT DOCUMENTS

| | | | |
|---|---|---|---|
| 3,755,704 | 8/1973 | Spindt | 313/309 |
| 3,789,471 | 2/1974 | Spindt et al. | 445/50 |
| 3,812,559 | 5/1974 | Spindt et al. | 445/50 |
| 3,894,332 | 7/1975 | Nathanson et al. . | |
| 3,921,022 | 11/1975 | Levine . | |
| 3,998,678 | 12/1976 | Fukase et al. . | |
| 4,008,412 | 2/1977 | Yuito et al. . | |
| 4,178,531 | 12/1979 | Alig . | |
| 4,307,507 | 12/1981 | Gray et al. . | |
| 4,513,308 | 4/1985 | Greene et al. . | |
| 4,536,942 | 8/1985 | Chao et al. | 437/80 |
| 4,578,614 | 3/1986 | Gray et al. . | |
| 4,685,996 | 8/1987 | Busta et al. . | |
| 4,721,885 | 1/1988 | Brodie | 313/576 |
| 4,827,177 | 5/1989 | Lee et al. | 313/306 |
| 4,874,981 | 10/1989 | Spindt | 313/309 |
| 4,970,887 | 7/1976 | Smith et al. . | |
| 4,975,382 | 12/1990 | Takasugi | 437/203 |

FOREIGN PATENT DOCUMENTS

| | | |
|---|---|---|
| 0172089 | 7/1985 | European Pat. Off. . |
| 2604823 | 10/1986 | France . |
| 855782 | of 0000 | U.S.S.R. . |
| 2204991A | 11/1988 | United Kingdom . |

OTHER PUBLICATIONS

A Vacuum Field Effect Transistor Using Silicon Field Emitter Arrays, by Gray, 1986 IEDM.

Advanced Technology: flat cold-cathode CRTs, by Ivor Brodie, Information Display 1/89.

Field-Emitter Arrays Applied to Vacuum Flourescent Display, by Spindt et al. Jan., 1989 issue of IEEE Transactions on Electronic Devices.

Field Emission Cathode Array Development for High--Current Density Applications by Spindt et al., dated Aug., 1982 vol. 16 of Applications of Surface Science.

*Primary Examiner*—Kenneth J. Ramsey

*Attorney, Agent, or Firm*—Steven G. Parmelee

[57] ABSTRACT

A cold cathode field emission device having a cone shaped emitter (112, 208) formed with a substantially normal (but not absolutely normal) vapor deposition process (109) wherein the substrate (101, 201) need not be rotated with respect to the vapor deposition target. The vapor deposition process forms an encapsulating layer (111, 207) that can either be utilized as an electrode within the completed device, or that can be removed to allow subsequent construction of additional layers.

20 Claims, 2 Drawing Sheets

NON-PLANAR FIELD EMISSION DEVICE HAVING AN EMITTER FORMED WITH A SUBSTANTIALLY NORMAL VAPOR DEPOSITION PROCESS

TECHNICAL FIELD

This invention relates generally to cold cathode field emission devices, and more particularly to formation of field emission devices having electrodes that are oriented substantially non-planar with respect to one another.

BACKGROUND OF THE INVENTION

Cold cathode field emission devices (FEDs) are known in the art. FEDs have two or more electrodes, including an emitter and a collector. In addition, one or more gates may be provided to modulate operation of the device.

FEDs having substantially non-planar oriented electrodes are also known. In one prior art embodiment, the emitter constitutes a cone shaped object. Both a substantially normal vapor deposition process and a low angle vapor deposition process are used (typically simultaneously) to form the cone. The substantially normal vapor deposition process provides material to support construction of the emitter cone, and the low angle vapor deposition process provides for continual closing of an aperture that increasingly restricts introduction of material from the normal deposition process, thereby allowing gradual construction of the cone.

The above process gives rise to a number of problems. For example, the substrate upon which the FEDs are formed must be continually rotated during the low angle vapor deposition process in order to assure symmetrical closing of the aperture. In the absence of such symmetrical closing, the resultant emitter cone may be misshapen and likely ineffective to support its intended purpose. As another example, the normal and low angle vapor deposition processes typically occur simultaneously. Since the two processes typically result in deposition of differing materials, the resultant occluding layer (which is comprised of a mixture of materials) must almost always be removed in order to allow provision of a functional device.

Accordingly, a need exists for a method of forming substantially non-planar FEDs that substantially avoids at least some of these problems.

SUMMARY OF THE INVENTION

These needs and others are substantially met through provision of the FED formation methodology disclosed herein. Pursuant to this invention, a body having a cavity formed therein provides the foundation for a subsequent substantially normal (but not absolutely normal) vapor deposition process that allows construction of a substantially symmetrical emitter cone within the cavity. During this process, the cavity becomes closed in a substantially symmetrical manner, thereby facilitating construction of the emitter cone.

This method requires no low angle vapor deposition process to close the cavity aperture. Instead, since the vapor deposition process used is substantially, but not absolutely, normal, sufficient lateral movement of the deposition particles exists to ensure that material will be applied to the sides of the cavity opening, thereby closing the cavity during processing.

In one embodiment of the invention, the upper encapsulating layer is removed subsequent to formation of the emitter, to allow subsequent processing steps to continue.

Pursuant to another embodiment of the invention, the encapsulating layer remains and functions as one electrode of the resultant device.

BEST MODE FOR CARRYING OUT THE INVENTION

Figure 1A:
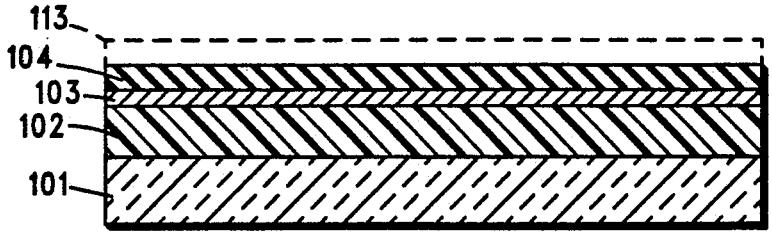
FIGS. 1*a–f* provide an enlarged side elevational cutaway depiction of structure resulting from various steps in constructing various embodiments of an FED in accordance with the invention.

Pursuant to one embodiment of the invention, a substrate (101) (FIG. 1*a*) can have a dielectric layer (102), a metallization layer (103), and a photoresist layer (104) deposited thereon in accordance with well understood prior art deposition technique. The photoresist may then be selectively exposed and developed, and preselected portions of the photoresist (104) and metallization layer (103) can be removed (106) (FIG. 1*b*) through and etching process.

A reactive ion etching process can then be utilized to allow removal of a preselected portion of the dielectric layer (102) to form a continuation (107) of the cavity. In this embodiment, an amount of dielectric material (102) is removed sufficient to allow exposure of at least a portion of the substrate (101). Also depicted in this embodiment, the etching of the dielectric material (102) can continue until an undercut (108) has been established. Though not necessary, provision of such an undercut will assist in later removal of excess metal if so desired.

A substantially (but not absolutely) normal vapor deposition process occurs upon application of energy to a vapor deposition target (not shown) that is comprised of the desired conductive deposition material, as understood in the art. The vaporized material will move in a substantially normal direction (109) with respect to the substrate (101) and become deposited both within the cavity and on top of the photoresist layer (104). Material falling to the bottom of the cavity forms the emitter cone (112). Material falling on top of the photoresist layer (104) forms an encapsulating layer (111).

Since the vapor deposition materials move in a substantially, but not statistically absolute, normal direction with respect to the device being formed, a lateral motion component exists in some of the material particles. Some of these particles become deposited upon the sidewalls of the cavity, and progressively close the aperture of the cavity. As the aperture closes, less material can enter the cavity, thereby substantially facilitating the construction of a cone shaped emitter (112). If desired, the substrate (101) need not be rotated with respect to the vapor deposition target.

Eventually, the cavity aperture will become totally occluded. The emitter cone (112) will be complete at this time (see FIG. 1*e*). The deposited upper metallization (111) and the intervening photoresist layer (104) can then be intervening photoresist layer (104) can then be removed through known methodology to provide the substrate (101), dielectric (102), and metallization layer (103) depicted in FIG. 1*f*, inclusive of the cone shaped emitter (112) formed in the cavity thereof. Additional dielectric, insulator, and/or metallization and encapsulation layers can thereafter be added in accordance with well understood prior art technique in order to construct a resultant field emission device having the desired electrode architectures and operating characteristics. Specific architectures employed after this point are not especially relevant to an understanding of the invention, and hence will not be described in further detail.

Figure 1B:
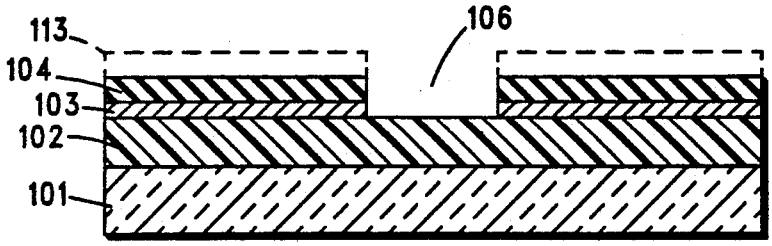
Figure 1C:
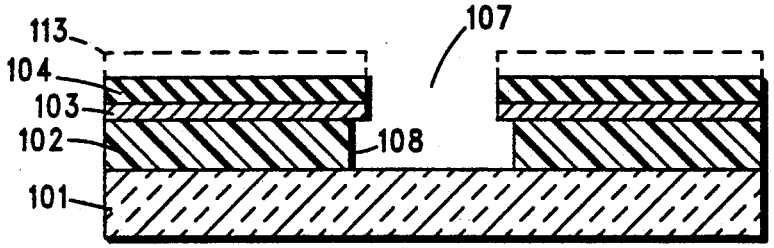
Figure 1D:
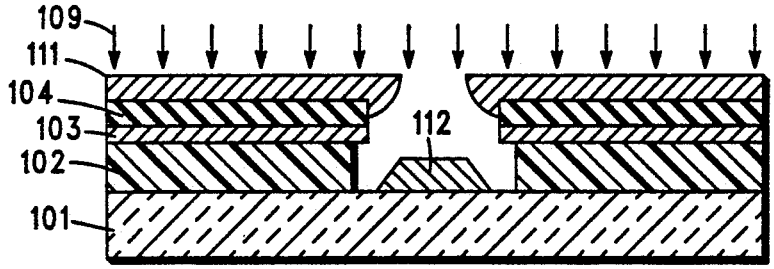
Figure 1E:
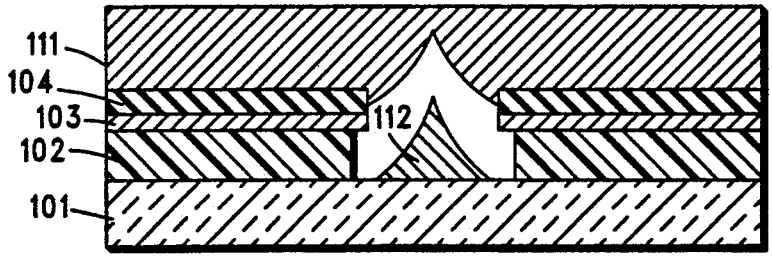
Figure 1F:
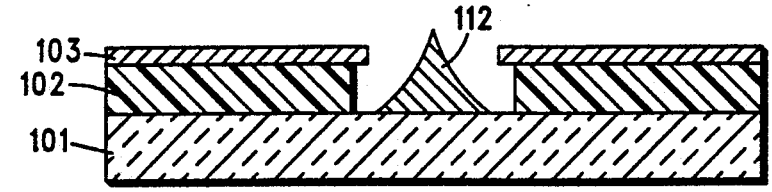

Pursuant to another embodiment of the invention, and referring again to FIG. 1*a*, an initial body comprised of a substrate (101), a dielectric (102), a metallization layer (103), an insulator (104), and a photoresist layer (113) can be initially provided. A cavity (106) can then be etched through the metallization layer (103), the insulator (104), and the photoresist layer (113). As depicted in FIG. 1*b* , the dielectric layer (102) can then again be etched to complete the cavity (107). The vapor deposition process then deposits conductive material both within the cavity to form the emitter (112) as described above and on top of the insulating layer (104). The resultant device appears as in FIG. 1*e*, wherein the device is comprised of a substrate (101), a dielectric layer (102), a metallization layer (103) that can function as a gate, an insulator (104), and a metallization layer (111) that can function as a collector (unlike prior art methodologies where this encapsulating layer is comprised of a mixture of materials unsuitable for this function and purpose). The emitter cone (112) is positioned within the encapsulated cavity. (Presuming that the vapor deposition process occurs in a rarified atmosphere the cavity will be evacuated to further support the desired electron emission activity during operation of the device.)

Figure 2A:
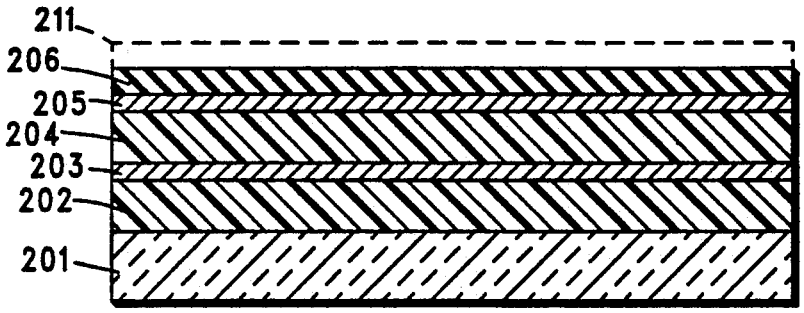
FIG. 2*a–c* provide an enlarged side elevational cutaway depiction of structure resulting from various steps in constructing various embodiments of an FED in accordance with the invention.
Figure 2B:
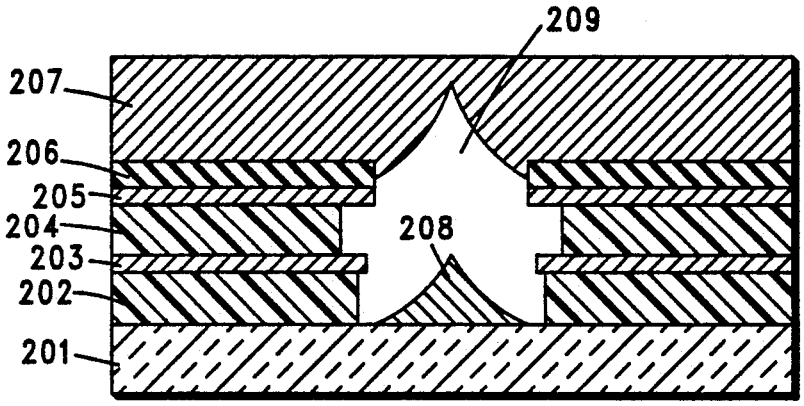
Figure 2C:
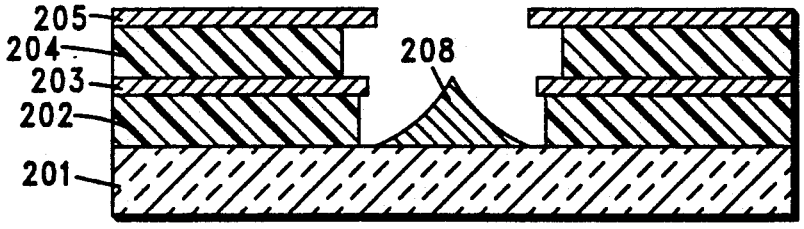

Another embodiment of the invention will now be described with reference to FIGS. 2*a–c*. In a first embodiment, the process supports provision of a body comprising a substrate (201), a dielectric (202), a first metallization layer (203), a second dielectric (204), a second metallization layer (205), and a photoresist layer (206) (see FIG. 2*a*). Material etching processes are utilized as described above to remove preselected portions of all but the substrate layer to form a cavity (209) (FIG. 2*b*). A substantially normal (but not absolutely normal) vapor deposition process again deposits material within the cavity (209) to form the cone shaped emitter (208) and to deposit an encapsulating layer (207) atop the photoresist layer. The encapsulating layer (207) and the photoresist layer (206) can then be removed to provide a device having an emitter (208) and two metallization layers (203 and 205) that can serve, for example, as gates in a resultant completed device.

The device may be completed in various ways that are not pertinent to an understanding of the invention; hence, these subsequent steps need not be set forth here.

In an alternative embodiment, the second metallization layer (205) (FIG. 2*a*) can be followed by an insulator (206). A photoresist layer (211) can then be deposited upon the insulator (206). The etching process can continue as before to form the cavity (209), and, subsequent to removal of the photoresist layer (211), the vapor deposition process can be utilized to form the emitter (208) and an encapsulating metallization layer (207) atop the insulator (206) to form the substantially completed device as depicted in FIG. 2*b*. This device includes an emitter (208), two gates (203 and 205), and a collector (207).

In other embodiments, the insulating and/or dielectric layers could be formed by successive depositions and/or oxide growths, in order to provide an insulator/dielectric layer that will not break down in the presence of electric fields in existance within a particular device.

What is claimed is:

1. A method of forming a substantially non-planar cold-cathode field emission device, comprising the steps of:

(a) providing a body having a cavity formed therein;

(b) forming an emitter within the cavity through use only of a substantially, but not absolutely, normal encapsulated by build up of material deposited onto the body at the edge of the cavity through said substantially normal vapor deposition process.

2. The method of claim 1 wherein the step of providing a body having a cavity formed therein includes the steps of:

(a1) providing a substrate;

(a2) forming at least one deposition layer on the substrate;

(a3) removing a portion of the at least one deposition layer to thereby form the cavity.

3. The method of claim 2 wherein the step of removing a portion of the at least one deposition layer includes the step of removing an amount of the deposition layer sufficient to expose a portion of the substrate.

4. The method of claim 3 wherein the step of forming an emitter within the cavity includes the step of forming the emitter such that the emitter contacts at least a part of the exposed portion of the substrate.

5. The method of claim 2 wherein the at least one deposition layer includes a photoresist layer, and wherein the step of forming an emitter through use of a vapor deposition process further includes the step of depositing material via the vapor deposition process on the photoresist layer.

6. A method of forming a substantially non-planar cold-cathode field emission device, comprising the steps of:

(a) providing a body having a cavity formed therein;

(b) forming an emitter within the cavity through use of a substantially, but not absolutely, normal vapor deposition of a predetermined material, wherein the cavity becomes encapsulated by build up of the predetermined material deposited onto the body at the edge of the cavity through said substantially normal vapor deposition process.

7. The method of claim 6 wherein the step of providing a body having a cavity formed therein includes the steps of:

(a1) providing a substrate;

(a2) forming at least one deposition layer on the substrate;

(a3) removing a portion of the at least one deposition layer to thereby form the cavity.

8. The method of claim 7 wherein the step of removing a portion of the at least one deposition layer includes the step of removing an amount of the deposition layer sufficient to expose a portion of the substrate.

9. The method of claim 8 wherein the step of forming an emitter within the cavity includes the step of forming the emitter such that the emitter contacts at least a part of the exposed portion of the substrate.

10. A method of forming a substantially non-planar cold-cathode field emission device, comprising the steps of:

(a) providing a body having a cavity formed therein;

(b) energizing a vapor deposition target to facilitate a vapor deposition process, wherein the target and the body remain substantially fixed with respect to each other and wherein the cavity becomes closed during the vapor deposition process, to thereby form an emitter within the cavity.

11. The method of claim 10 wherein the step of providing a body having a cavity formed therein includes the steps of:

(a1) providing a substrate;

(a2) forming at least one deposition layer on the substrate;

(a3) removing a portion of the at least one deposition layer to thereby form the cavity.

12. The method of claim 11 wherein the step of removing a portion of the at least one deposition layer includes the step of removing an amount of the deposition layer sufficient to expose a portion of the substrate.

13. The method of claim 12 wherein the step of forming an emitter within the cavity includes the step of forming the emitter such that the emitter contacts at least a part of the exposed portion of the substrate.

14. A method of forming a substantially non-planar cold-cathode field emission device, comprising the steps of:

(a) providing a substrate;

(b) forming at least one dielectric layer on the substrate;

(c) forming a metallization layer on the dielectric layer;

(d) forming a photoresist layer on the metallization layer;

(e) removing preselected portions of the photoresist layer, the metallization layer, and the dielectric layer to thereby form at least one cavity having an opening;

(f) energizing a vapor deposition target to facilitate a vapor deposition process, wherein the target and the substrate remain substantially fixed with respect to each other and wherein the cavity becomes closed during the vapor deposition process, to thereby form an emitter within the cavity.

15. The method of claim 14, and further including the step of:

(g) removing at least a substantial portion of material deposited during the vapor deposition process, with the exception of the emitter.

16. The method of claim 15, and further including the step of:

(h) removing at least a substantial portion of the photoresist layer.

17. The method of claim 16, and further including the step of:

(i) forming a dielectric layer on the metallization layer.

18. A method of forming a substantially non-planar cold-cathode field emission device, comprising the steps of:

(a) providing a substrate;

(b) forming a dielectric layer on the substrate;

(c) forming a metallization layer on the dielectric layer;

(d) forming an insulating layer on the metallization layer;

(e) forming a photoresist layer on the insulating layer;

(f) removing preselected portions of the photoresist layer, the insulating layer, the metallization layer, and the dielectric layer to thereby form at least one cavity having an opening;

(g) removing at least some remaining portions of the photoresist layer;

(h) energizing a vapor deposition target to facilitate a vapor deposition process, wherein the target and the substrate remain substantially fixed with respect to each other and wherein the cavity becomes closed during the vapor deposition process, to thereby form:

(i) an emitter within the cavity; and (ii) an encapsulating anode over the opening and on at least part of the insulating layer.

19. A method of forming a substantially non-planar cold-cathode field emission device, comprising the steps of:

(a) providing a body having a cavity formed therein;

(b) forming an emitter within the cavity through use only of a normal vapor deposition process having a small amount of resultant lateral deposition, wherein the cavity becomes encapsulated by build up of material deposited onto the body at the edge of the cavity through said substantially normal vapor deposition process.

20. A method of forming a substantially non-planar cold-cathode field emission device, comprising the steps of:

(a) providing a substrate;

(b) forming a plurality of layers on the substrate, wherein the layers include at least:

(i) an insulating layer;

(ii) a dielectric layer disposed between the substrate and the insulating layer;

(iii) a metallization layer disposed between the substrate and the insulating layer;

(c) forming a photoresist layer on the insulating layer;

(d) removing preselected portions of at least some of the plurality of layers and the photoresist layer to thereby form at least one cavity having an opening;

(e) removing at least some remaining portions of the photoresist layer;

(f) energizing a vapor deposition target to facilitate a vapor deposition process, wherein the target and the substrate remain substantially fixed with respect to each other and wherein the cavity becomes closed during the vapor deposition process, to thereby form:

(i) an emitter within the cavity; and (ii) an encapsulating anode over the opening and on at least part of the insulating layer.

* * * * *

UNITED STATES PATENT AND TRADEMARK OFFICE

CERTIFICATE OF CORRECTION

PATENT NO. : 5,007,873

DATED : April 16, 1991

INVENTOR(S) : Herbert Goronkin et al.

It is certified that error appears in the above-identified patent and that said Letters Patent is hereby corrected as shown below:

In claim 1, Col. 4, line 16, after the word "normal" please insert the words --vapor deposition process, wherein the cavity becomes--.

Signed and Sealed this

Eighth Day of December, 1992

*Attest:*

DOUGLAS B. COMER

*Attesting Officer*

*Acting Commissioner of Patents and Trademarks*